US009537259B2

(12) United States Patent
Mastel et al.

(10) Patent No.: US 9,537,259 B2
(45) Date of Patent: Jan. 3, 2017

(54) PLUG-TYPE CONNECTOR ARRANGEMENT AND CODING ELEMENT THEREFOR AND METHOD FOR CODING A PLUG-TYPE CONNECTOR ARRANGEMENT

(71) Applicant: WAGO Verwaltungsgesellschaft mbH, Minden (DE)

(72) Inventors: Rudolf Mastel, Porta Westfalica (DE); Cord-HEnrik Licht, Rinteln (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/729,447

(22) Filed: Jun. 3, 2015

(65) Prior Publication Data

US 2015/0357756 A1 Dec. 10, 2015

(30) Foreign Application Priority Data

Jun. 5, 2014 (DE) ..... 10 2014 107 948

(51) Int. Cl.
*H01R 13/64* (2006.01)
*H01R 13/639* (2006.01)
*H01R 13/645* (2006.01)

(52) U.S. Cl.
CPC ..... *H01R 13/639* (2013.01); *H01R 13/6456* (2013.01)

(58) Field of Classification Search
CPC .... H01R 13/64; H01R 13/639; H01R 13/6456
USPC ..... 439/681, 680
See application file for complete search history.

(56) References Cited

U.S. PATENT DOCUMENTS 3,656,086 A * 4/1972 Debaigt ..... H01R 13/514 439/362
4,747,792 A * 5/1988 Strate ..... H01R 13/64 439/681
4,813,892 A * 3/1989 Strate ..... H01R 13/64 439/680
5,044,994 A * 9/1991 Van Woensel ..... H01R 13/6456 439/681
6,383,032 B1 * 5/2002 Gerberding ..... H01R 13/645 439/681

(Continued)

FOREIGN PATENT DOCUMENTS

DE 27 08 291 8/1978
DE 10 2011 051 567 B4 1/2013

(Continued)

*Primary Examiner* — Hae Moon Hyeon
(74) *Attorney, Agent, or Firm* — Renner, Otto, Boisselle & Sklar, LLP

(57) ABSTRACT

A plug-type connector arrangement includes a plug-type connector and an opposing plug-type connector, which each have an insulating housing and plug-type contacts in the insulating housing. The plug-type connector also includes plug-type contours configured correspondingly to one another for plugging together and for electrically conductively connecting assigned plug-type contacts in the plugged-together state. The plug-type connector arrangement also includes at least one coding element, which can be accommodated displaceably on the plug-type contours of the plug-type connector and opposing plug-type connector, and fixes a permissible plug-in position for plugging together the plug-type connector and the opposing plug-type connector.

19 Claims, 13 Drawing Sheets

(56) References Cited

U.S. PATENT DOCUMENTS

| | | | | |
|---|---|---|---|---|
| 7,997,941 | B2 * | 8/2011 | Pfaffenbach | H01R 13/645 439/680 |
| 8,888,522 | B2 * | 11/2014 | Schrader | H01R 13/64 439/353 |
| 8,911,263 | B2 * | 12/2014 | Becavin | H01R 13/64 439/680 |
| 2015/0357754 | A1 * | 12/2015 | Mastel | H01R 24/68 439/345 |

FOREIGN PATENT DOCUMENTS

| | | |
|---|---|---|
| EP | 0 235 339 | 9/1987 |
| EP | 2 091 108 A1 | 8/2009 |
| GB | 1 568 189 | 5/1980 |

* cited by examiner

PLUG-TYPE CONNECTOR ARRANGEMENT AND CODING ELEMENT THEREFOR AND METHOD FOR CODING A PLUG-TYPE CONNECTOR ARRANGEMENT

FIELD OF THE INVENTION

The invention relates to a plug-type connector arrangement comprising a plug-type connector and an opposing plug-type connector, which each have an insulating housing and plug-type contacts in the insulating housing and plug-type contours configured correspondingly to one another for plugging together and for electrically conductively connecting assigned plug-type contacts in the plugged-together plugging state, and comprising at least one coding element, which can be accommodated displaceably on the plug-type contours of the plug-type connector and opposing plug-type connector and fixes a permissible plug-in position for plugging together the plug-type connector and the opposing plug-type connector.

Furthermore, the invention relates to a coding element for such a plug-type connector arrangement and to a method for coding such a plug-type connector arrangement using at least one such coding element.

DESCRIPTION OF RELATED ART

In plug-type connector arrangements, the plug-type contours are each matched to one another by virtue of shaping of the insulating housings in such a way that a plug-type connector in a permissible plug-in position can be connected to an opposing plug-type connector and erroneous plugging is safely prevented.

However, there are use sectors in which identical plug-type connectors or opposing plug-type connectors are used for different functions and a replacement of such plug-type connectors needs to be safely prevented. In this regard, it is known to provide the plug-type connectors and/or the opposing plug-type connectors with separate coding elements, which are necessarily fitted on the plug-type contour of the insulating housings.

DE 10 2011 051 567 B4 discloses a plug-type connection arrangement comprising a coding element, which is in the form of an elongate coding pin for arrangement in a groove-shaped recess in the plug-type connection arrangement. The coding element has a varying width and an outwardly curved region. A cutout is provided between the mutually opposite side faces in the region of the curvatures, said cutout having a spring effect on the coding element in order to introduce the curved side faces with a precise fit into the groove-shaped recess and to hold them there.

EP 2 091 108 A1 discloses a plug-type connection in which coding elements are prefitted as a prefittable unit on in each case at least one of the plug-type connector parts. During axial plugging-together of the two plug-type connector parts for the first time, one of the two coding elements prefitted for the coding is fixed on the respective other plug-type connector part and, once the plugged-together plug-type connector parts are released for the first time, remains on this other plug-type connector part. Two associated coding elements forming a coding apparatus are thus first fitted together on a first plug-type connector part and delivered with this. During first use, the coding elements are then separated and one of the coding elements of the first plug-type connector part latches with the corresponding coding element and with the second plug-type connector part. During later use of the plug-type connectors, coding is achieved by the now separated coding elements.

EP 0 235 339 A1 discloses a multipole plug-type connector, whose plug-in part and female connector part have a contour which is matched to one another, which contours together form plug-type receptacles for coding elements which can be inserted thereon. For this purpose, dovetail guides and additional grooves and ribs are provided on the upper side of the plug part or on the upper inner wall of the male connector part. The coding elements are pushed into the dovetail guides.

GB 1 568 189 A discloses a plug-type connector arrangement comprising a coding element, which has a tapered end. The coding element is inserted with the broader end into a plug-type connector and held there. When an opposing plug-type connector is plugged on, the tapered end enters a contour of the opposing plug-type connector without entering into a force-fitting connection.

BRIEF SUMMARY OF THE INVENTION

Against this background, the object of the present invention consists in providing an improved plug-type connector arrangement and an improved coding element and a method for coding a plug-type connector arrangement.

The object is achieved by the plug-type connector having the features of Claim 1 and by the coding element having the features of Claim 12 and by the method having the features of Claim 17. Advantageous embodiments are described in the dependent claims.

For a plug-type connector arrangement formed from a plug-type connector and an opposing plug-type connector and at least one coding element, it is proposed that the plug-type contours both of the plug-type connector and of the opposing plug-type connector have connecting elements. Furthermore, the at least one coding element has at least two connecting elements which are spaced apart from one another. The connecting elements of the coding element are designed to be detachably connected in a form-fitting and/or force-fitting manner to a respectively assigned connecting element of the plug-type connector or the opposing plug-type connector. The at least one coding element is accessible and displaceable from the outside in the state in which the plug-type connector and the opposing plug-type connector are at least partially plugged together. The form-fitting detachable connection of the assigned connecting elements can be detached from the coding element and the plug-type connector, and the coding element, once it has been displaced in the direction of the opposing plug-type connector by means of the assigned connecting element of the coding element and the opposing plug-type connector, can now be connected to the opposing plug-type connector.

In accordance with the teaching of the present invention, the coding element is thus connectable in a form-fitting and/or force-fitting manner either to the plug-type connector or to the opposing plug-type connector. This form-fitting connection can be canceled in order to connect the coding element optionally either to the plug-type connector or to the opposing plug-type connector in a form-fitting and/or force-fitting manner.

The coding element is therefore, so to speak, latched over in order to thus fix a specific coding of the plug-type connector and the opposing plug-type connector.

In the delivery state, the coding element is delivered connected in a form-fitting and/or force-fitting manner to the plug-type connector or the opposing plug-type connector. On first use, latching over of at least one selected coding element can take place, which coding element is then detached from the plug-type connector and connected to the opposing plug-type connector, or vice versa. It is also conceivable for selected coding elements also provided and connected to be completely removed from the plug-type connector or opposing plug-type connector prior to said coding elements being plugged together. The displacement and "latching over" of the coding element is made possible by virtue of the fact that the coding element has in each case one connecting element for the plug-type connector and for the opposing plug-type connector, which connecting elements are spaced apart from one another. For this purpose, the connecting elements can be opposite one another, for example in the direction of longitudinal extent of the coding element, i.e. can be arranged at the diametrically opposite end regions of the coding element. However, it is also conceivable for the connecting elements to be opposite one another transversely to the direction of longitudinal extent. They can then still be spaced apart from one another in the direction of longitudinal extent, if required.

The coding element therefore has a guide contour for receiving, in linearly displaceable fashion, on a plug-type connector and an opposing plug-type connector of the plug-type connector arrangement as well as connecting elements which are spaced apart from one another (for example at mutually opposite end sections) for detachable form-fitting and/or force-fitting connection to a respectively assigned plug-type connector or opposing plug-type connector. In the plugged-together state of the plug-type connector and the opposing plug-type connector, the coding element is therefore connected to the plug-type connector or to the opposing plug-type connector detachably and in a form-fitting and/or force-fitting manner. The connection can be changed by displacing the coding element once the detachable connection has been canceled.

The coding of a plug-type connector arrangement therefore takes place by

- detachably connecting, in a form-fitting and/or force-fitting manner, the at least one coding element to the plug-type connector;
- plugging together the plug-type connector with an opposing plug-type connector, and
- detaching the connection between at least one selected coding element and the plug-type connector, displacing the selected coding element in the direction of the opposing plug-type connector and detachably connecting, in a form-fitting and/or force-fitting manner, the selected coding element to the opposing plug-type connector.

The coding elements can therefore already be fitted on a first plug-type connector component part in the factory. The coding can be adjusted individually by the user by displacing and latching selected coding elements on the second plug-type connector component part, if required. Therefore, no separate coding elements other than individual parts still to be fitted by the user are provided any more.

A plug-type connector is understood to mean a male connector part or female connector part, and an opposing plug-type connector is understood to mean the plug-type connector part corresponding thereto, i.e. in the case of a male connector a female connector part or in the case of a female connector part the male connector part.

A detachable connection is understood to mean that the connecting element of the male connector part or opposing male connector part engages with the connecting element of the coding element one inside the other in such a way that the two connection partners, namely the plug-type connector or opposing plug-type connector and the coding element connected thereto can no longer readily be detached from one another. This is achieved, for example, by virtue of the fact that a section of one connecting element is in the way of a section of the other connecting element as the coding element is withdrawn and therefore forms a stop, i.e. latching. However, it is also conceivable for the connection to be provided by a force-fitting connection, in which a connecting element exerts a force on the assigned other connecting element. This can take place, for example, by a spring arm of the coding element, which, by virtue of friction locking, provides a detachable connection between the coding element and the plug-type connector or opposing plug-type connector. However, a combination of a form-fitting and a force-fitting detachable connection is also conceivable.

The connecting elements of the plug-type connector and the opposing plug-type connector are preferably in the form of latching troughs. The connecting elements of the at least one coding element, on the other hand, are in the form of latching fingers. In this case, the latching fingers and latching troughs have a contour which is adapted for plugging a latching finger into a latching trough and for detachably connecting the latching finger plugged into the latching trough by means of a latching stop and/or by means of a force-fitting connection. It is thus conceivable for the latching finger to be plugged into a latching trough and for friction locking to be exerted on the inner wall of the latching trough with the aid of a projecting section or spring arm. This needs to be overcome in order to detach the connection and displace the coding element. Such a displacement can be achieved, for example, with the aid of a screwdriver acting from the outside on the coding element. In this case, the coding element is nevertheless still secured on the plug-type connector or opposing plug-type connector in such a way that it cannot readily fall out in the non-plugged-together state.

In another embodiment, however, the latching finger and the latching trough can also form a latching stop for forming a form-fitting connection. For this purpose, the latching finger can have a latching projection, which interacts with a depression in the latching trough. The latching fingers in this case preferably extend in the direction of longitudinal extent of the coding pin. In this case, in each case one latching finger is provided preferably on both sides of the coding pin at the mutually diametrically opposite ends. These latching fingers in this case have laterally protruding latching projections, with which the coding element can be fixed detachably and in a form-fitting manner on the assigned connecting element of the plug-type connector or opposing plug-type connector. The latching troughs are preferably in the form of grooves having depressions in the groove walls for receiving assigned latching projections of a latching finger, plugged into the latching trough, of a coding element.

However, a reverse variant is also conceivable, in which the connecting elements of the plug-type connector and the opposing plug-type connector are in the form of latching fingers and the connecting elements of the coding element are in the form of latching troughs. The latching fingers and the latching troughs in this case have a contour which is adapted for plugging a latching finger into a latching trough and for detachably connecting, in a form-fitting and/or force-fitting manner, the latching finger plugged into a latching trough by means of a latching stop and/or a force-fitting connection.

A further preferred embodiment provides that the coding element has, on mutually diametrically opposite sides which face the plug-type connector on one side and the opposing plug-type connector on the other side in the plugged-in state, in each case one locking groove running in the direction of longitudinal extent of the coding element. Locking lugs protrude from the adjoining face of the plug-type connector and the opposing plug-type connector. Depending on the plug-in position, a locking lug protrudes into an assigned locking groove and forms a stop, which secures the coding element in the plug-in position either on the plug-type connector or on the opposing plug-type connector. The other locking lug in this case does not protrude into the assigned locking nut.

It is particularly advantageous if the plug-type contours of the plug-type connector and the opposing plug-type connector have linear guides for receiving, in linearly displaceable fashion, at least one coding element.

The at least one coding element then has a guide contour which is matched to the linear guide. Thus, the at least one coding element is held and guided in linearly displaceable fashion on a plug-type connector and the opposing plug-type connector.

The guide contour of the at least one coding element and the linear guide can in this case preferably form a dovetail guide. Thus, the coding element is not only guided linearly, but is also held on a plug-type connector or opposing plug-type connector.

The dovetail guide can be realized by virtue of the fact that the coding element has, on mutually opposite side faces, in each case one groove extending in the direction of longitudinal extent of the coding element and having walls which slope or curve towards one another.

It is particularly advantageous if the at least one coding element has protruding holding knobs on mutually opposite sides. In this case, the linear guides have a holding section, in which a holding strip formed by the linear guide rests in a force-fitting manner on an assigned holding knob of an inserted coding pin, which is connected to the plug-type connector or opposing plug-type connector. Furthermore, the linear guides having a widened withdrawal section, in which the linear guide is not in engagement with an assigned holding knob. By virtue of the force-fitting connection between the at least one holding strip of the plug-type connector and the assigned holding knob of the coding element, the coding element is connected to the plug-type connector. There is then no form-fitting and/or force-fitting connection between the coding element and the opposing plug-type connector even in the plug-in state of the opposing plug-type connector, which is plugged onto the plug-type connector. Only by virtue of latching over can the force-fitting connection with the plug-type connector be canceled in the case of a displacement of the coding element and a force-fitting connection between the holding strips of the opposing plug-type connector and the assigned holding knobs of the coding element be produced. Once the coding element has been displaced and connected to the plug-type connector or opposing plug-type connector, the holding knob is therefore moved into a position in which it bears in a force-fitting manner against the holding strip in the narrower holding section.

In this case, it is particularly advantageous if in each case two holding knobs are provided on the diametrically opposite side walls. The pairs of holding knobs are then arranged on a side wall in each case so as to be vertically offset and offset with respect to one another in the direction of longitudinal extent of the coding element. Thus, the plug-in direction and plug-in position of the coding element is as desired.

The at least one coding element is particularly advantageously mirror-symmetrical or point-symmetrical, with the result that the coding element can be inserted into an assigned linear guide of the plug-type connector or opposing plug-type connector and latched there irrespective of the plug-in direction and the orientation.

"Latching" is understood to mean detachable connection in the broadest sense, such as a form-fitting connection, for example with the aid of a stop, a force-fitting connection or a combination thereof.

BRIEF DESCRIPTION OF THE DRAWINGS

The invention will be explained in more detail below with reference to an exemplary embodiment using the attached drawings, in which.

DETAILED DESCRIPTION OF THE INVENTION

Figure 1:
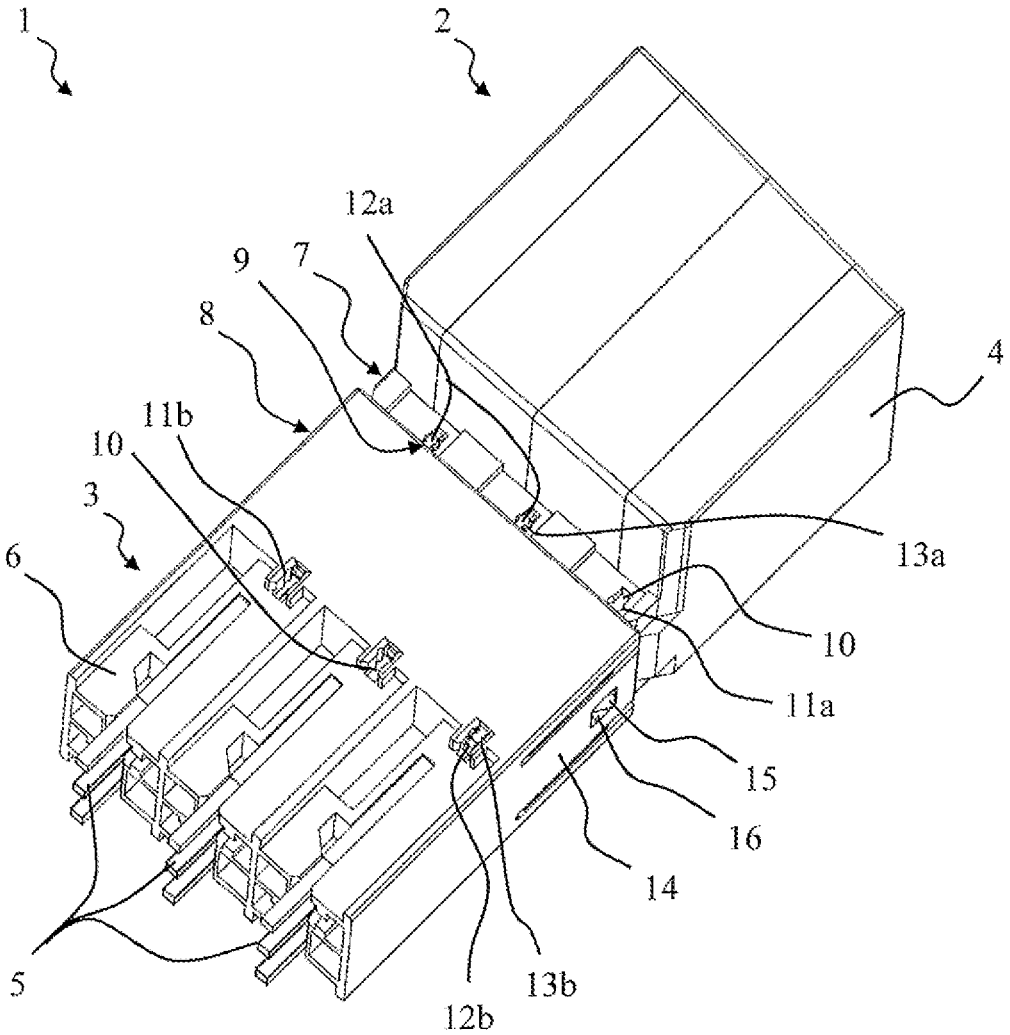
FIG. 1 shows a perspective view of a plug-type connector arrangement comprising a plug-type connector, an opposing plug-type connector and comprising displaceable coding elements.

FIG. 1 shows a perspective view of a plug-type connector arrangement 1 comprising a plug-type connector 2 and an opposing plug-type connector 3, which have a plug-type contour which is designed for plugging together and electrically conductively connecting assigned plug-type contacts of the plug-type connector 2 and the opposing plug-type connector 3. The plug-type connector 2 has an insulating housing 4 with plug-type contacts (not shown) accommodated therein and with conductor insertion openings on the rear side (not shown). The conductor insertion openings are provided for plugging in electrical conductors in order to make electrically conductive contact between inserted electrical conductors and an assigned plug-type contact in the insulating housing, for example by means of a spring-loaded clamping connection, a screw connection, an insulation displacement clamping connection or the like. In the exemplary embodiment shown, spring-loaded clamping contacts are arranged in the interior of the insulating housing 4 and can be actuated by actuating means, for example. The opposing plug-type connector 3 in the exemplary embodiment illustrated is in the form of a printed circuit board plug-type connector, in which connection contacts 5 protrude out of the insulating housing 6 of the opposing plug-type connector 3. These connection contacts 5 are connected to plug-type contacts in the interior of the insulating housing 6 of the opposing plug-type connector 3 in order to come into electrically conductive contact with corresponding plug-type contacts of the plug-type connector 2 in the plugged-together state illustrated.

The plug-type contour 7 of the plug-type connector 2 and the corresponding plug-type contour 8 of the opposing plug-type connector 3 have linear guides, (not visible) on their upper side, for example, for receiving, in linearly displaceable fashion, at least one coding element 9. In the exemplary embodiment illustrated, these linear guides are in the form of a groove with sloping sections of the side walls in order to form a dovetail guide. A T-shaped groove is also conceivable as guide profile or the like.

The coding elements 9 then have a corresponding contour matched thereto in order to be mounted in linearly displaceable fashion in the dovetail guide. It becomes clear that the linear guides have receiving pockets 10 comprising connecting means 11*a*, 11*b* in the end regions of said linear guides, wherein the free ends 12*a*, 12*b* of the coding elements 9 which are diametrically opposite one another in the direction of longitudinal extent and point in opposite directions from one another, can be detachably connected to said connecting elements by means of a form-fitting connection. These connecting elements 11*a*, 11*b* of the receiving pockets 10 are in the form of latching troughs, for example, which provide a latching stop for a connecting element 13*a*, 13*b*, inserted into the latching trough, of a coding element 9, which connecting element can be formed, for example, by means of latching projections at the respective free end 12*a*, 12*b* in the form of latching fingers. Thus, a stop is formed by a form-fitting connection, which stop prevents easy displacement of the coding element 9 without any further application of force from the outside.

In the delivery state, the coding elements 9 are already inserted in the plug-type connector 2 or the opposing plug-type connector 3 and are detachably connected there to one another with their corresponding connecting elements 11*a*, 13*a*; 11*b*, 13*b* by means of a form-fitting and/or force-fitting connection.

The latching fingers (i.e. the connecting elements 13*a*, 13*b*) are accessible in the region of the connecting elements 11*a*, 11*b* of the receiving pockets 10 of the linear guides from the outside, in the plug-in state illustrated. Thus, a coding element 9 can be "latched over" if required by virtue of, for example, the form-fitting connection and/or force-fitting connection between the coding element 9 and the connecting element 13*a* or 13*b* being canceled with the aid of a screwdriver and the coding element 9 being displaced towards the opposite connecting element 13*b* or 13*a* in order to be latched there (i.e. in order to be connected detachably there in a form-fitting and/or force-fitting manner) in the linear guide. This takes place in the exemplary embodiment illustrated in such a way that the front coding element 9 (in the viewing direction) is latched over towards the opposing plug-type connector 3 and is now connected to the opposing plug-type connector 3. The other two coding elements 9, on the other hand, are still connected to the plug-type connector 2, as in the delivery state. Thus, coding of the plug-type connector 2 and the opposing plug-type connector 3 is achieved which enables only one correspondingly coded plug-type connector 2 to be plugged together with the opposing plug-type connector 3 and therefore prevents erroneous plugging of plug-type connectors 2 and opposing plug-type connectors 3 which do not match one another.

It can furthermore be seen that a latching tab 14 is provided on the side wall of the insulating housing 6 of the opposing plug-type connector 3. A protruding latching lug 15 is arranged on the side wall of the insulating housing 4 of the plug-type connector 2. In the plug-in state illustrated, the protruding latching lug 15 enters a latching opening 16 in the latching tab 14 in order to thus prevent the opposing plug-type connector 3 from being withdrawn from the plug-type connector 2 in an undesirable manner. Such a latching tab 14 can also be provided additionally on the opposite side of the opposing plug-type connector 3. Correspondingly, a latching lug 15 is then also provided on the opposite side wall of the insulating housing 4 of the plug-type connector 2.

The latching-over of the coding elements 9 is thus enabled in the plug-in state (as can be seen from FIG. 1), in which the plug-type connector 2 and the opposing plug-type connector 3 are plugged together and an electrically conductive connection between assigned plug-type contacts is thus produced.

Figure 2:
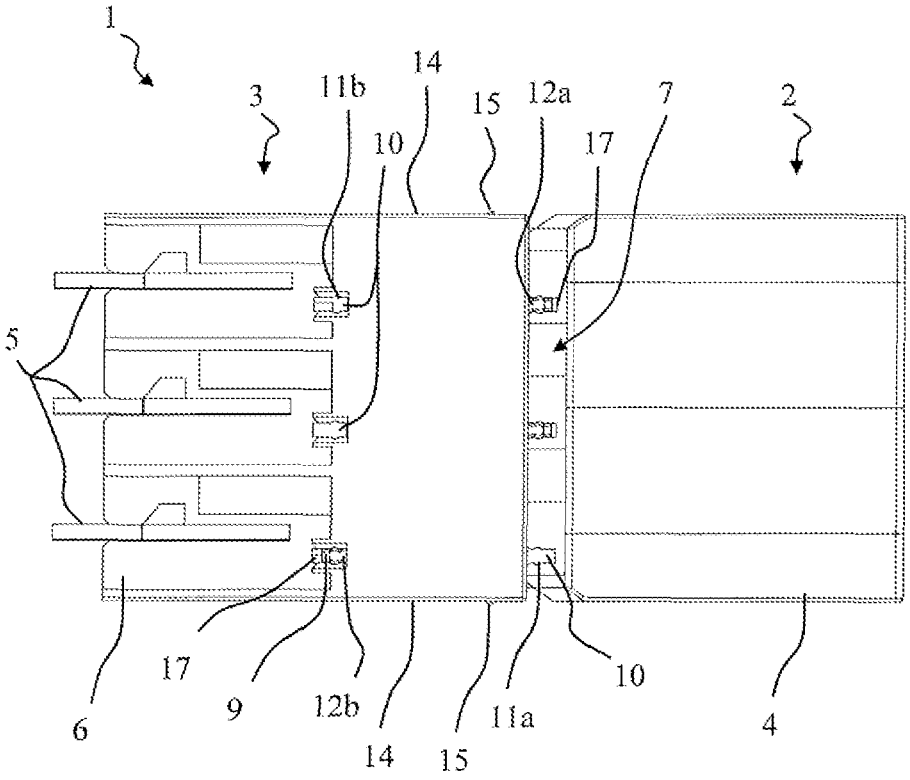
FIG. 2 shows a plan view of the plug-type connector element shown in FIG. 1.
Figure 2A:
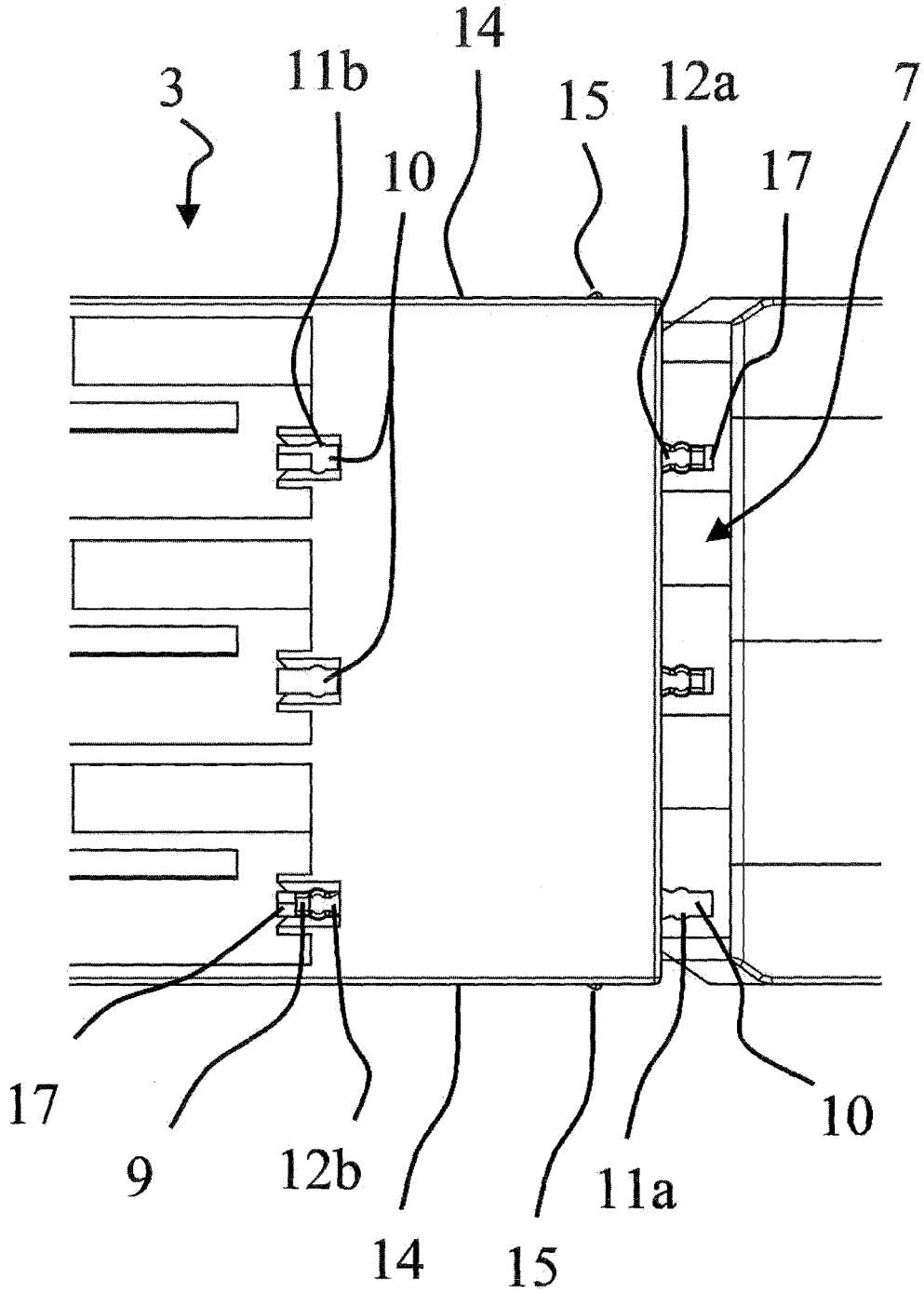
FIG. 2A shows a detailed view of a portion of FIG. 2.

FIGS. 2 and 2A show a plan view of the plug-type connector arrangement 1 shown in FIG. 1. In this case, it can again be seen that the coding elements 9 in the plug-in state illustrated are accessible from the outside and can be shifted in the respectively assigned linear guide, of which only the receiving pockets 10 are shown. For this purpose, the free ends 12*a*, 12*b* of the coding elements 9, which have the connecting elements 13*a*, 13*b* (i.e. the latching fingers), can have a displacement force applied to them by a screwdriver, for example, in order thus to cancel the detachable connection between the interacting connecting elements 11*a*, 13*a*; 11*b*, 13*b*, which are in the form of latching fingers and latching troughs, and to displace the coding element 9 for detachable connection to the opposite plug-type connector 2 or opposing plug-type connector 3. It is shown that a gap 17 is also provided between the end side of the free end of the coding elements 9 in the latched state and the receiving pockets 10 at the outgoing ends of the linear guide, said gap making it possible for an actuating tool (for example screwdriver) to be inserted into this gap 17.

It is also shown that, in the latching state illustrated, the latching tab 14 terminates flush with the side wall of the insulating housing 6 of the opposing plug-type connector 3 and the latching lug 15 of the plug-type connector 2 protrudes slightly out of the plane of the surface of the latching tab 14. In this case, such latching lugs 15 are provided on both side walls of the plug-type connector 2 and corresponding latching tabs 14 on the opposing plug-type connector 3, diametrically opposite one another.

Figure 3:
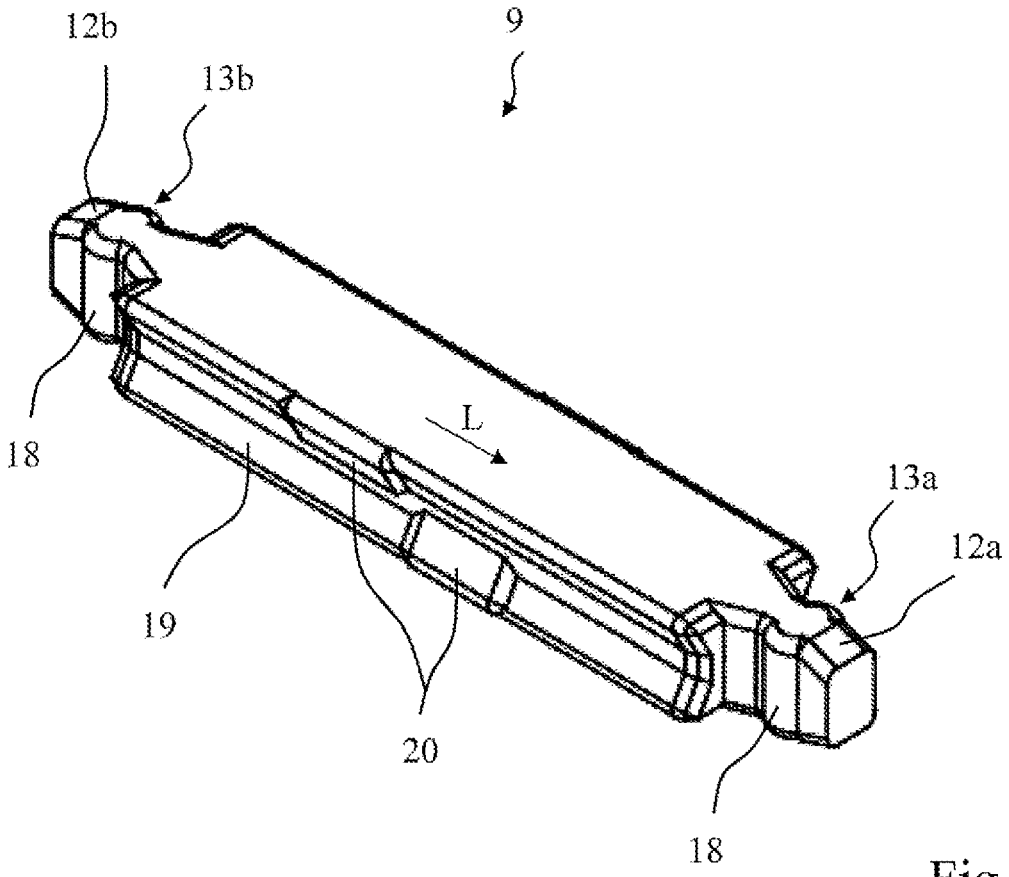
FIG. 3 shows a perspective view of a coding element for the plug-type connector arrangement shown in FIGS. 1 and 2.

FIG. 3 shows a perspective view of a coding element 9. This coding element 9 in the exemplary embodiment illustrated is point-symmetrical. The coding element 9 is in principle in the form of a rectangular bar which extends in the direction of longitudinal extent L and which has in each case one latching finger as locking element 13*a*, 13*b* with diametrically opposite, laterally protruding latching projections 18 at the mutually opposite free ends 12*a*, 12*b*. These mutually opposite latching fingers with their latching projections 18 form connecting elements 13*a*, 13*b*, which are provided for detachable, form-fitting connection to the latching troughs (i.e. the connecting elements 11*a*, 11*b*) in the mutually diametrically opposite receiving pockets 10 at the outgoing ends of the linear guides of the plug-type connector 2 and the opposing plug-type connector 3.

Owing to the fact that the coding elements 9 are formed from an elastically deformable plastic material, the latching projections 18 are pressed into the assigned receiving pocket 10, which is narrower than the main section of the linear guide, at the end of the linear guides until they enter the assigned latching troughs (i.e. the connecting elements 11*a*, 11*b*) and a latching stop for form-fitting connection of the coding element 9 and the receiving pockets 10 of the linear guide is provided there. Alternatively, instead of the latching fingers and latching troughs, latching hooks or latching tabs can also be provided, which interact with latching projections in order to provide a form-fitting stop and possibly a force-fitting connection. Also conceivable is a reverse variant, in which the latching troughs are provided at the free ends 12*a*, 12*b* of the coding elements 9 and enter into a form-fitting and/or force-fitting connection with latching projections in the receiving pockets 10.

It is furthermore shown that the diametrically mutually opposite side walls 19 of the coding elements 9 slope towards one another in order to form a guide contour, which is matched to the contour of the linear guides. In the exemplary embodiment illustrated, a groove is provided by the sloping or curved side walls 19 on the diametrically opposite side walls 19 of the coding elements 9, said groove providing a dovetail guide with the linear guide of the plug-type connectors 2 and the opposing plug-type connector 3. It can furthermore be seen that in each case two holding knobs 20 are arranged on the side walls 19 so as to be offset in the direction of longitudinal extent L on two different vertical planes, i.e. also vertically offset, which holding knobs protrude from the plane of the guide contour formed on the side wall 19. In each case two such holding knobs 20 are arranged on the diametrically opposite side so as to be vertically offset in relation to the upper side and lower side of the coding element 9 on a plane and so as to be offset with respect to one another in the direction of longitudinal extent L. In this case, the holding knobs 20 are arranged in such a way that the coding element 9 is point-symmetrical.

Figure 4:
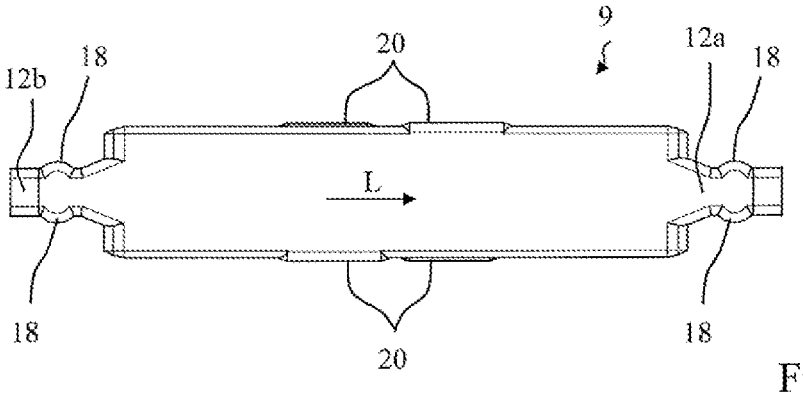
FIG. 4 shows a plan view of the coding element shown in FIG. 3.

This point-symmetrical configuration of the coding element 9 is shown more clearly in the plan view of the coding element 9 from FIG. 3 in FIG. 4. It can be seen that the in each case one pair of holding knobs 20 lie on the diametrically opposite sides on a common vertical plane parallel to the upper side of the coding element 9 and are arranged offset with respect to one another in the direction of longitudinal extent L. However, it is also conceivable for the holding knobs 20 to be arranged one above the other. A further pair of holding knobs 20 is located diametrically opposite one another on a further, vertical plane, said pair of holding knobs being arranged in turn offset with respect to one another in the direction of longitudinal extent. In each case one holding knob 20 is diametrically opposite a holding knob 20, which is arranged offset with respect to the vertical plane. On rotation of the coding element 9 through 180° about the longitudinal axis and through 180° about the transverse axis, the same contour is thus provided by the point-symmetrical formation. Thus, the coding element 9 can be used in reverse, i.e. in any desired position without previous orientation in the linear guide.

It is furthermore shown that the latching projections 18 of the latching fingers 13 provide an oval latching projection in cross section.

Figure 5:
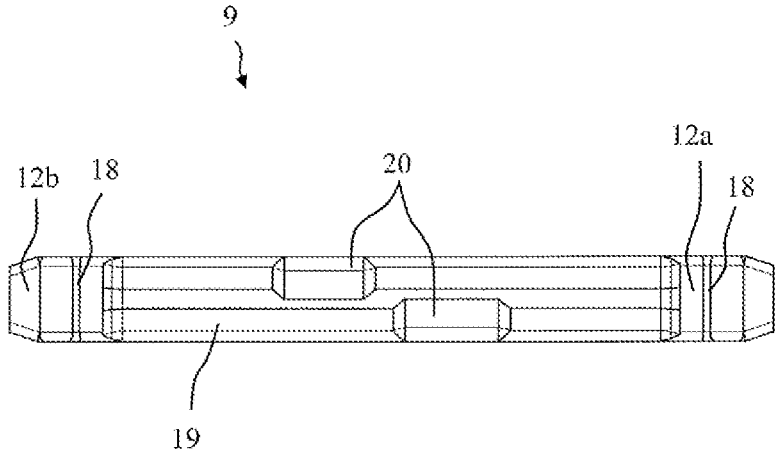
FIG. 5 shows a side view of the coding element shown in FIGS. 3 and 4.

FIG. 5 shows the coding element 9 in a side view. This shows that the two holding knobs 20 are arranged on one side in each case on two planes which are arranged vertically offset with respect to one another, on one side adjacent to the upper side and on the other side adjacent to the lower side of the coding element 9.

Figure 6:
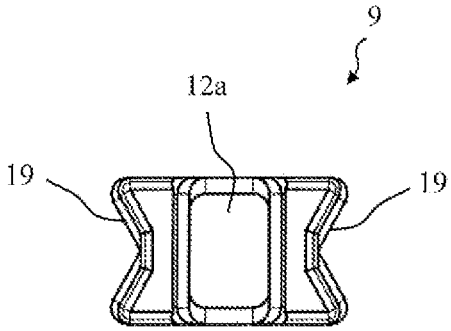
FIG. 6 shows a front view of the coding element shown in FIGS. 3 to 5.

FIG. 6 shows a front view of the coding element 9 from FIGS. 3 to 5. It is shown here that in each case one V-shaped groove is formed by walls sloping towards one another on the diametrically mutually opposite side walls 19. Thus, a dovetail guide of the coding element 9 is provided.

Figure 7:
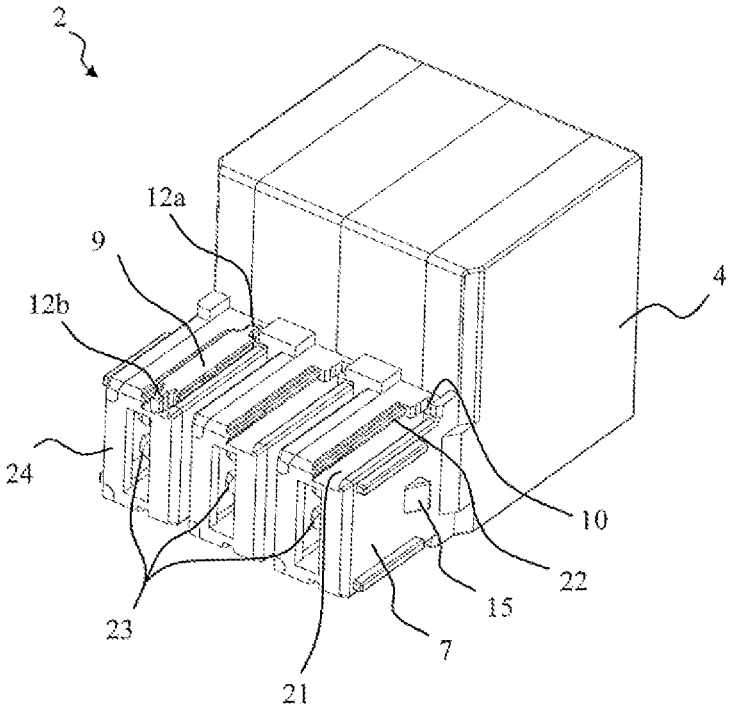
FIG. 7 shows a perspective view of the plug-type connector of the plug-type connector arrangement shown in FIG. 1 comprising a coding element.

FIG. 7 shows a perspective view of the plug-type connector 2 of the plug-type connector arrangement 1 comprising only one coding element 9. It is shown that this coding element 9 is designed in terms of its length such that, in the plugged state of an opposing plug-type connector 3, it can still be displaced in the direction of the opposing plug-type connector 3. In the exemplary embodiment illustrated, the free end 12*b* of the coding element 9 latched on the plug-type connector 2 ends at the free end of the plug-type contour 7 of the plug-type connector 2.

It is furthermore shown that the now visible linear guides 21 have holding strips 22 on the plug-type contour 7 on the upper side of the plug-type connector 2. In each case mutually opposite holding strips 22 which point towards one another are arranged in the linear guide 21 in such a way that they enter the guide contour of an inserted coding element 9 and hold the coding element 9 at least in the latching position illustrated, in which it is connected to the plug-type connector 2.

It can furthermore be seen that the holding strips 22 do not extend over the entire length of the linear guide 21 of the plug-type connector 2, but end before the free end of the plug-type connector 2. The holding strips 22 then only act on the holding knobs when the coding element 9 is displaced in the direction of the connecting element 11*a*, 11*b*, i.e. in the direction of the latching trough in the receiving pocket 10 of the linear guide 21. This latching trough is arranged on both sides in the side walls of the receiving pocket 10 at the ends of the groove forming the linear guide 21.

It can furthermore be seen that plug-type contacts 23 are arranged in the interior of the insulating housing 4. For this purpose, the plug-type contour 7 has protective sleeves 24, which are formed integrally, i.e. without any joins, with the insulating housing 4 from insulating material and surround the assigned plug-type contacts 23. The opposing plug-type connector 3 is now inserted with its corresponding plug-type contacts into the opening in the protective sleeves 24, with the result that the plug-type contacts of the opposing plug-type connector 3 in the plug-in state come into electrically conductive contact with the plug-type contacts 23 of the plug-type connector 2.

Figure 8:
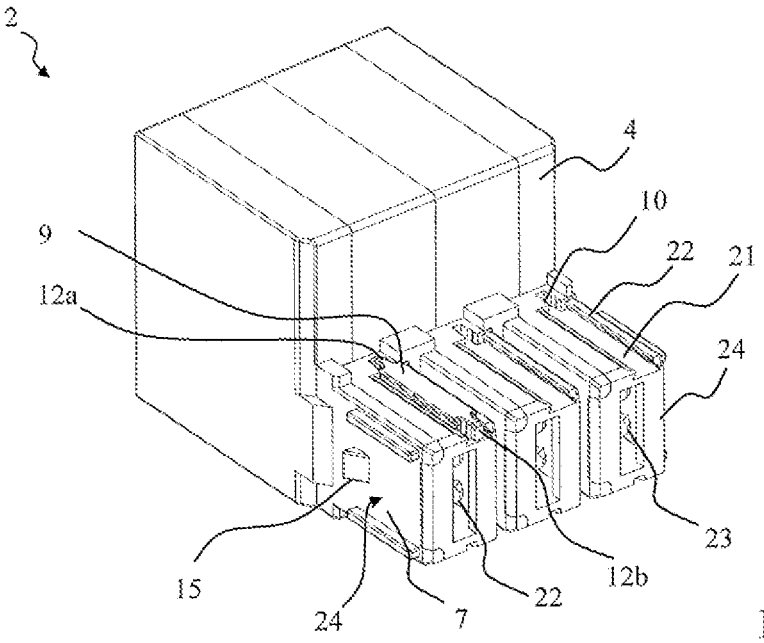
FIG. 8 shows a perspective view of the plug-type connector shown in FIG. 7 from the other side.

FIG. 8 shows a perspective view of the plug-type connector 2 shown in FIG. 7 from the other side. It is shown here that a latching lug 15 is also arranged on the side wall of the insulating housing 4.

It can also be seen that likewise a holding strip 22 with a shortened length is provided on the opposite side (in comparison with FIG. 7) of the linear guide 21. The length of this holding strip 22 is shorter than on the opposite side, or vice versa. This is due to the holding knobs 20 arranged offset on a common plane in the direction of longitudinal extent L of the coding element 9.

The linear guide 21 is then supplemented by a corresponding guide contour on the inner side of the insulating housing 6 of the opposing plug-type connector 3 in order to provide a dovetail guide. It can be seen that the coding element 9 protrudes out of the plane of the upper side of the plug-type contour 7 of the plug-type connector 2, which is formed by the protective sleeves 24.

Figure 9:
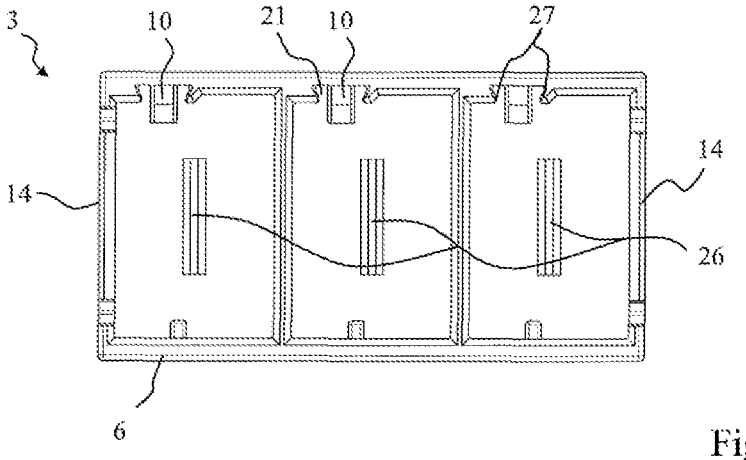
FIG. 9 shows a front view of the plug-in side of the opposing plug-type connector of the plug-type connector arrangement shown in FIGS. 1 and 2.

FIG. 9 shows a front view of a plug-in side of the opposing plug-type connector 3 of the plug-type connector arrangement 1 shown in FIGS. 1 and 2. In this case, it is shown that a linear guide 21 is provided for each connection pole, i.e. for each of the plug-type contacts 26 arranged next to one another, on the inner wall of the upper side of the insulating housing 6. These linear guides 21 are formed by a groove, which widens conically towards the groove base and has sloping side walls having the holding strips 27. The upper part of a coding element 9 plugged onto the plug-type connectors 2, said upper part protruding out of the plane of the plug-type contour 7 of the plug-type connector 2, can likewise be guided displaceably on this linear guide 21. It can be seen that the linear guide 21 becomes a locking element 11*b*, which is formed in the receiving pocket 10 in the form of a blind hole and is designed for detachable connection of the coding element 9 by means of a form-fitting and/or force-fitting connection.

It can also be seen that the plug-type contacts 26 of the opposing plug-type connector 3 protrude as blade contacts in order to come into electrically conductive contact with mutually opposite spring clips of the plug-type connector 2, which form a fork contact.

Figure 10:
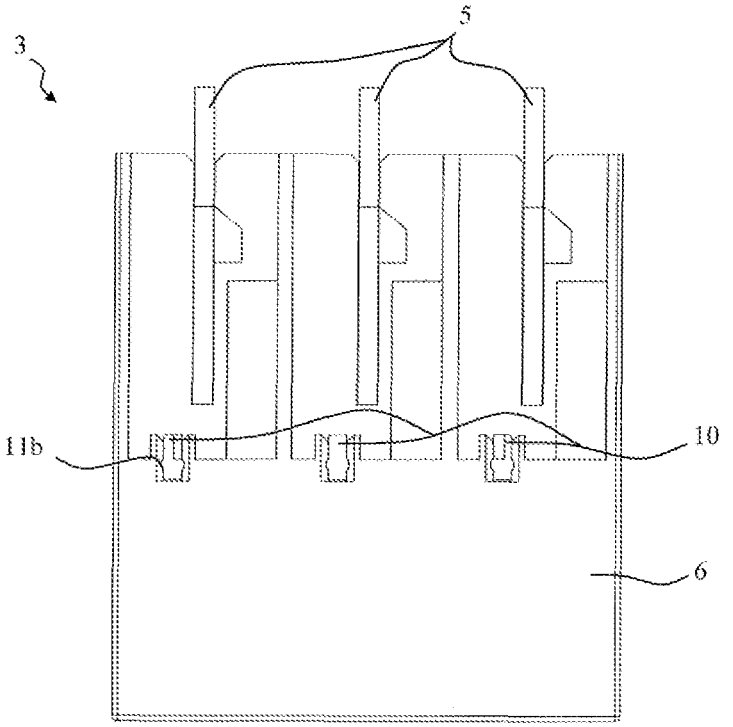
FIG. 10 shows a plan view of the opposing plug-type connector shown in FIG. 9.

FIG. 10 shows a plan view of the opposing plug-type connector 3 from FIGS. 1, 2 and 9. It is shown that the linear guides 21 each end in the receiving pocket 10 with the locking element 11*b* in the form of a latching trough, wherein the receiving pockets 10 are accessible from the upper side, i.e. are open on this side. It can also be seen that a plurality of such linear guides 21 are arranged next to one another. A linear guide 21 is provided for each plug-type contact 26, wherein the linear guides 21 are arranged offset in the transverse direction with respect to the direction of longitudinal extent L of the assigned plug-type contacts 26 and the connection contacts 5 connected thereto.

Figure 11:
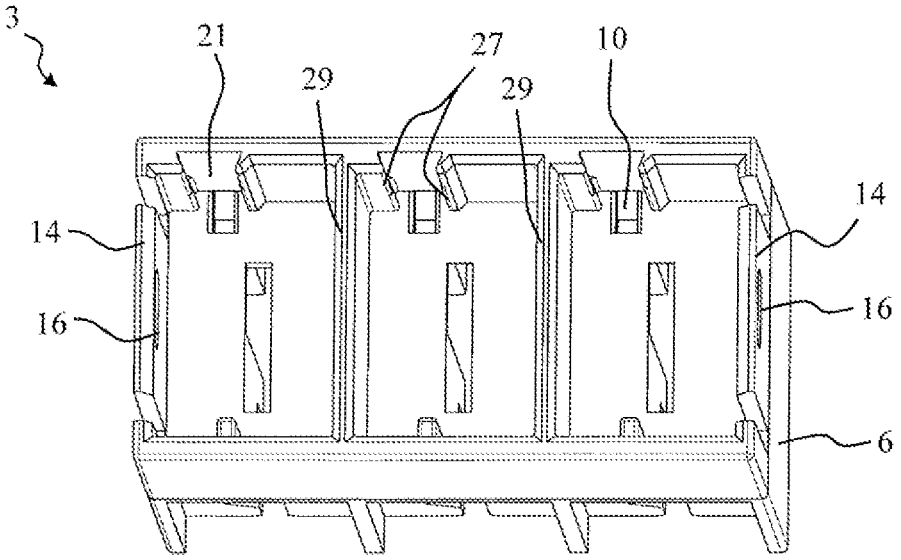
FIG. 11 shows a perspective view of the opposing plug-type connector shown in FIGS. 9 and 10.

FIG. 11 shows a perspective view of the opposing plug-type connector 3 from FIGS. 9 and 10. In this case, the linear guides 21 formed by the conically tapering groove, which have sloping wall sections for forming a dovetail guide for a respectively plugged-in coding element 9, are shown. Holding strips 27 are arranged on the wall sections. It can also be seen that in each case elastically resilient latching tabs 14 are provided on the diametrically opposite sides of the insulating housing 6. The perspective view shown in FIG. 11 only shows the insulating housing 6 without the plug-type contacts inserted therein.

Figure 12:
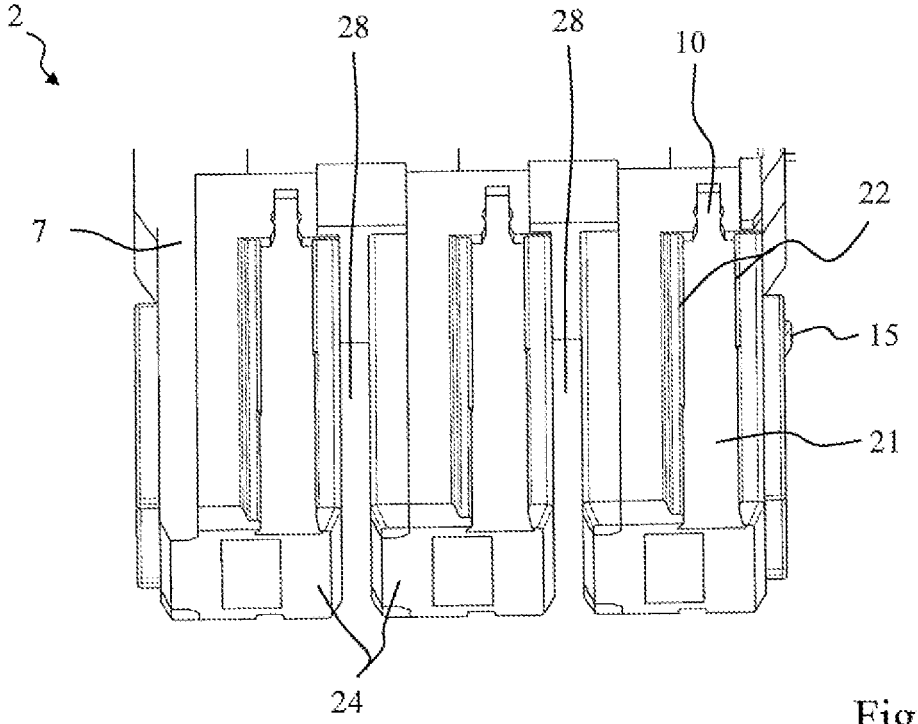
FIG. 12 shows a perspective detail view of the plug-type contour of the plug-type connector shown in FIGS. 7 and 8.

FIG. 12 shows a corresponding perspective detail view of the plug-type contour 7 of the plug-type connectors 2 shown in FIGS. 7 and 8. It can be seen here that the holding strips 22 constrict the receiving panel of the linear guide 21 so that the holding strips 22 can come into a force-fitting connection with the holding knobs 20 of a coding element 9. It can be seen that the diametrically mutually opposite holding strips 22 have a different length on the linear guide 21, which holding strips are matched to the position of the assigned holding knobs 20 in such a way that a force-fitting connection is ensured between the plug-type connector 2 and the coding element 9 or between the opposing plug-type connector 3 and the coding element 9 either in the locking position on the plug-type connector 2 or in the locking position on the opposing plug-type connector 3. The holding strips 22 are in this case matched to the holding knobs 20 in such a way that in no way is a force-fitting connection between the coding element 9 and both the plug-type connector 2 and the opposing plug-type connector 3 produced. The holding strips 22 are in this case arranged on the dovetail strips, which provide the dovetail guide for the coding elements 9.

It can also be seen that in each case one dedicated protective sleeve 24 is provided for each pole, i.e. for each plug-type contact. An intermediate wall 29 of the opposing plug-type connector 3 (cf. FIG. 11) can be inserted into the interspace 28 between two adjoining protective sleeves 24.

Figure 13:
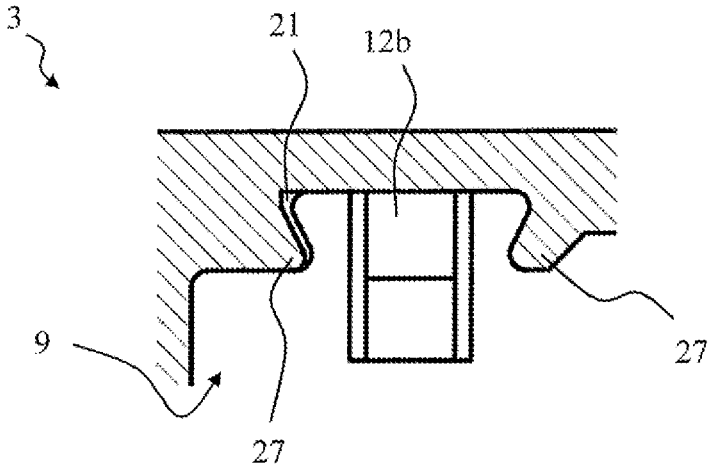
FIG. 13 shows a detail sectional view of the plug-type contour of the opposing plug-type connector.

FIG. 13 shows a detail sectional view of the plug-type contour 8 of the opposing plug-type connectors 3. It can be seen that a groove which widens conically towards the groove base is formed by the holding strips 27. Thus, half of a coding element 9 with its holding contour is received, which holding contour is formed by the mutually diametrically opposite, sloping walls 19.

A latching finger (i.e. the free end 12*a*, 12*b* with the locking element 13*a*, 13*b*) facing the opposing plug-type contact 3 can then enter the receiving pocket 10 and latch on the assigned locking element 11*a*, 11*b*, which is formed by the latching trough in the receiving pocket 10.

Figure 14:
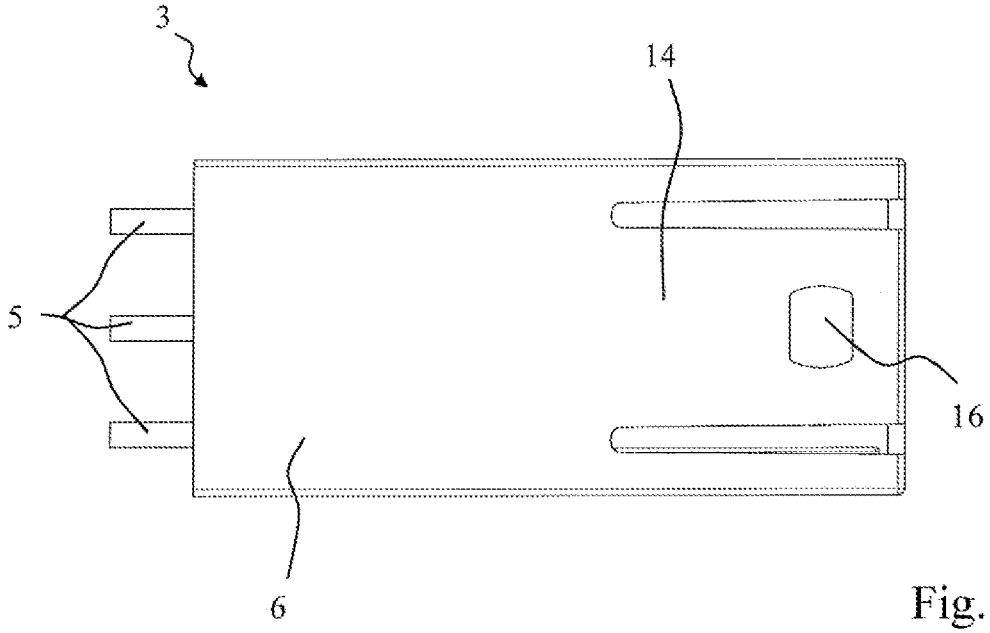
FIG. 14 shows a side view of the opposing plug-type connector comprising a latching tab.

FIG. 14 shows a side view of the opposing plug-type connector 3. It can be seen here that an elastically resilient latching tab 14 is cut free on the side wall of the insulating housing 6 of the opposing plug-type connector 3. This can take place by corresponding shaping during the injection-moulding process for producing the insulating housing 6 from a plastic material.

Figure 15:
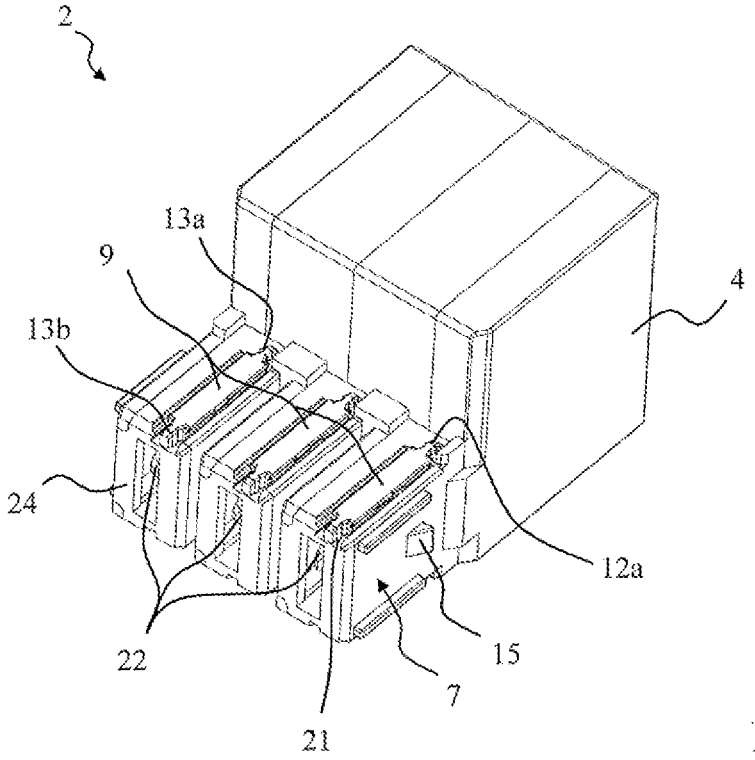
FIG. 15 shows a perspective view of a plug-type connector for the plug-type connector arrangement shown in FIG. 1 in the delivery state comprising three coding elements.

FIG. 15 shows a perspective view of the plug-type connector 2 for the plug-type connector arrangement 1 shown in FIG. 1 in the delivery state comprising three coding elements 9, which are detachably connected to the insulating housing 4 of the plug-type connector 2. For this purpose, the latching fingers, i.e. the free ends 12*a*, 12*b* in the form of locking elements 13*a*, 13*b* of the coding element 9 enter the locking elements 11*a*, 11*b* of the linear guide 21 on the side which is opposite the free ends of the plug-type contour 7 and are secured there by a latching stop. The coding elements 9 are thus connected undetachably to the plug-type connector 2 in the delivery state and do not need to be delivered as separate individual parts, which can be lost.

Figure 16:
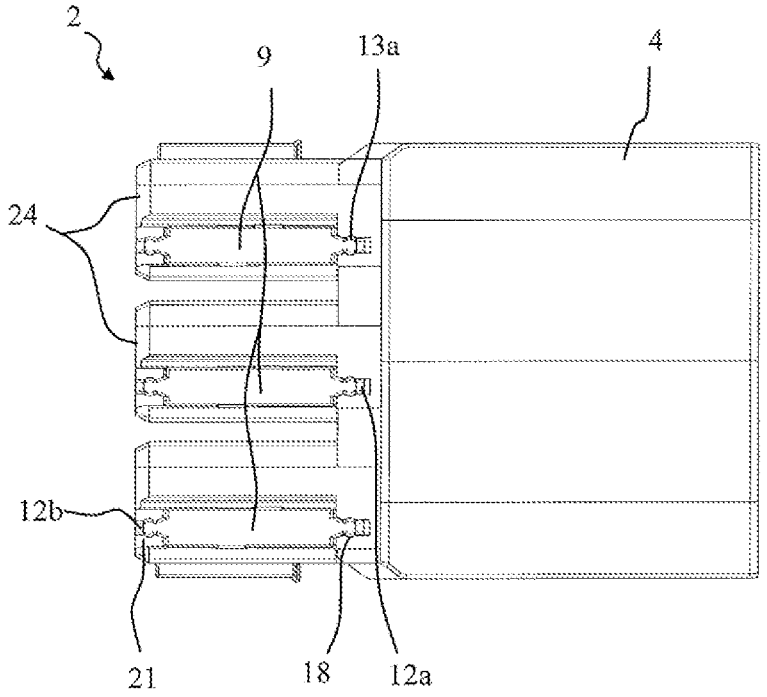
FIG. 16 shows a plan view of the plug-type connector shown in FIG. 15.

FIG. 16 shows a plan view of the plug-type connector 2 shown in FIG. 15. It is shown here that in each case one latching finger enters, at the free end 12*a*, 12*b* of a coding element 9, a narrow groove (i.e. the receiving pocket 10)

having the locking element 13*a*, 13*b* in the form of a latching trough and is connected detachably in a form-fitting manner and, owing to the elasticity of the protruding latching projections 18, possibly also in a force-fitting manner. In the case of a connection of the coding element 9 to the plug-type connector 2, the diametrically opposite locking element 13*b* on the latching finger of the coding element 9 is not connected in a form-fitting and/or force-fitting manner, on the other hand. Once the detachable connection of the locking element 13*a* to the plug-type connector 2 has been canceled, the opposite locking element 13*b* can be connected to a plugged-on opposing plug-type connector 3 once a coding element 9 has been displaced.

Figure 17:
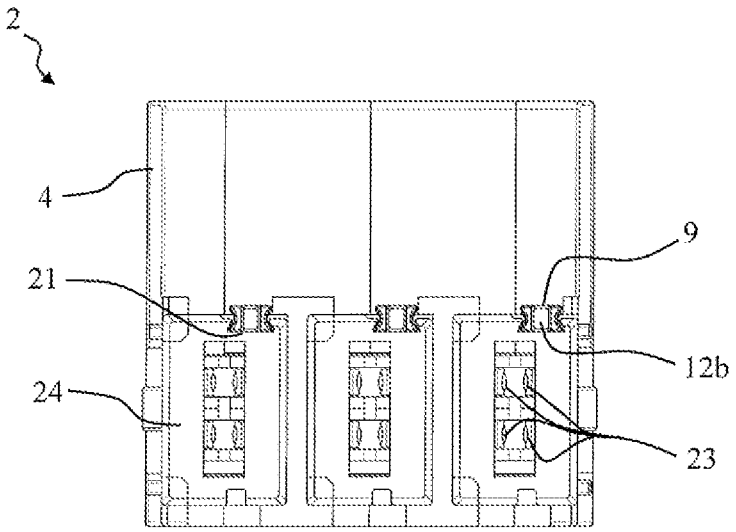
FIG. 17 shows a front view of the plug-in side of the plug-type connector shown in FIGS. 15 and 16.

FIG. 17 shows a front view of a plug-in side of the plug-type connector 2 from FIGS. 15 and 16. It is shown here that the coding elements 9 are guided in linearly displaceable fashion by a dovetail guide on the upper side of the protective sleeves 24 of the plug-type connector 2. It can also be seen that the plug-type contacts 23 are accessible from the front side through the interior of the protective sleeve 24 and are in the form of diametrically opposite spring clips for receiving a contact blade into the interspace.

Furthermore, it is shown that the coding elements 9 or the linear guides 21 for the coding elements 9 are arranged laterally offset with respect to the plug-type contacts 23. By virtue of different offsets, the coding possibilities can be increased.

Figure 18:
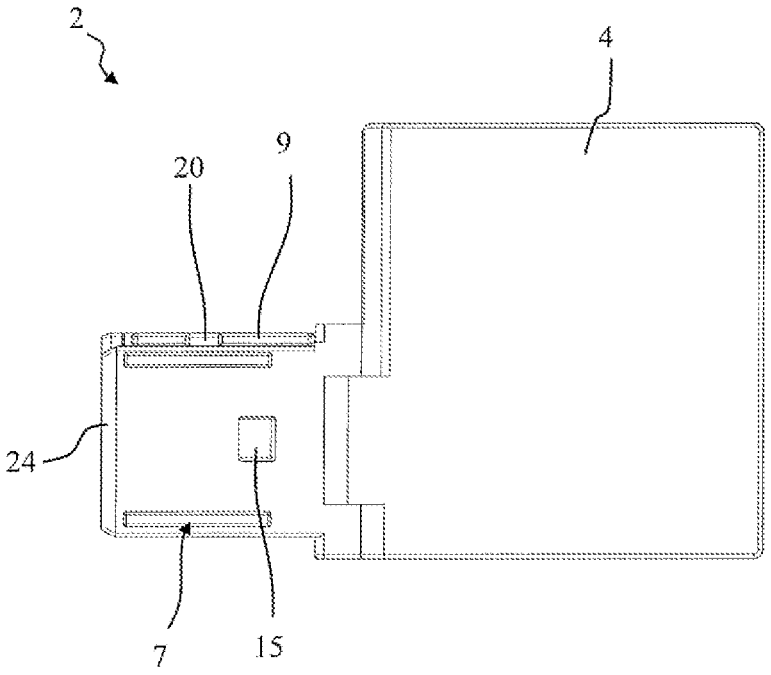
FIG. 18 shows a side view of the plug-type connector shown in FIGS. 15 to 17.

FIG. 18 shows a side view of the plug-type connector 2 shown in FIGS. 15 to 17. In this case, it can once again be seen that a latching lug 15 with a runout bevel which tapers on a slope in the plug-in direction, is arranged on the side wall of the outer protective sleeves 24 or the plug-type contour 7.

It can furthermore be seen that the coding elements 9 protrude beyond the plane of the upper side of the protective sleeves 24, i.e. the plug-type contour 7, in order to interact with a linear guide of the opposing plug-type connector 3.

Figure 19:
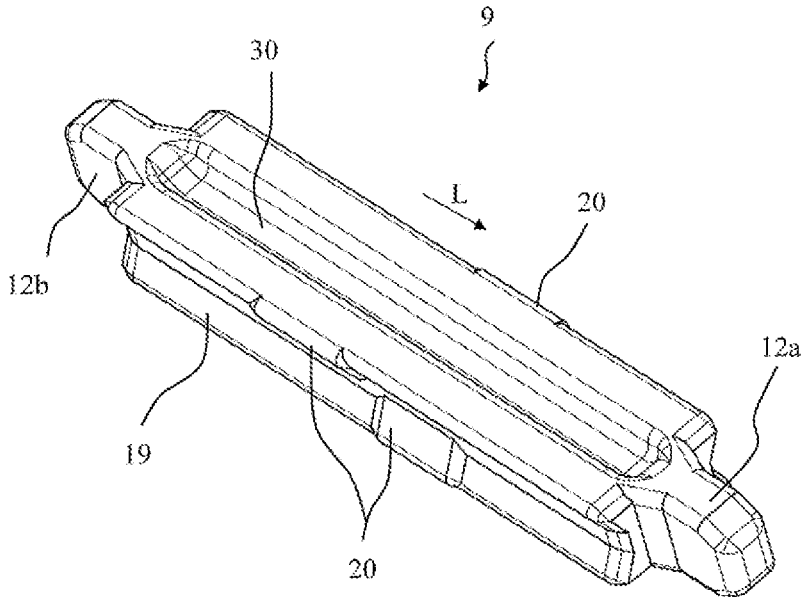
FIG. 19 shows a perspective view of a further embodiment of a coding element.

FIG. 19 shows a perspective view of a further embodiment of a coding element 9. In this case, a locking groove 30 which extends in the direction of longitudinal extent L of the coding element 9 is provided on the upper side and on the lower side. Said locking groove runs over the central region up to the free ends 12*a*, 12*b*. The free ends 12*a*, 12*b* for their part have, in contrast to the above described embodiment, no locking elements, for example in the form of bulges. The form-fitting and/or force-fitting connection of the coding element 9 either to a plug-type connector 2 or an opposing plug-type connector 3 takes place with the aid of the locking grooves 30 by virtue of an assigned locking lug 31 on the plug-type connector 2 or on the opposing plug-type connector 3 entering the locking groove 30.

Figure 20:
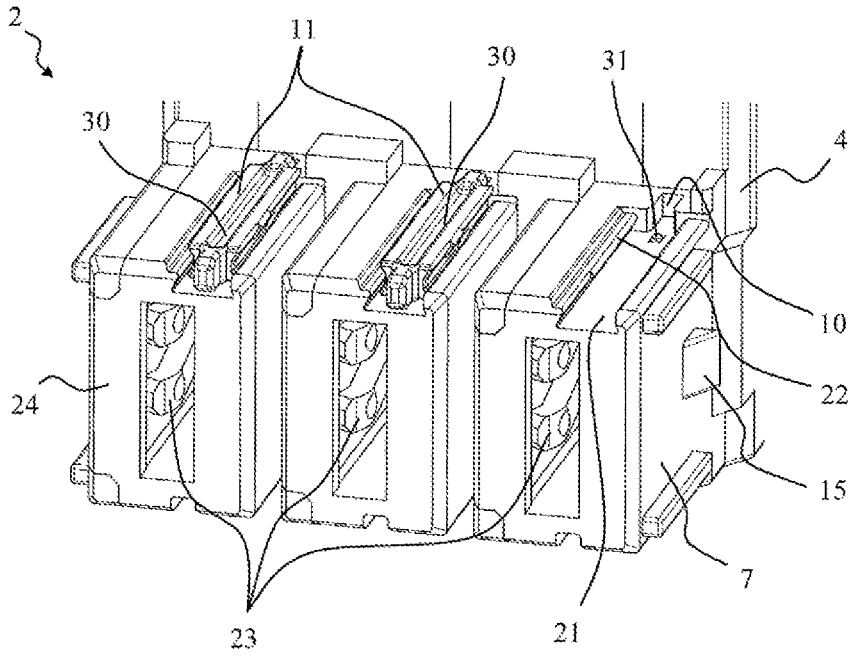
FIG. 20 shows a perspective detail view of the plug-type contour of a plug-type connector comprising a coding element as shown in FIG. 19.

FIG. 20 shows a perspective detail view of the plug-type contour of a plug-type connector 2 comprising coding elements 9 as shown in FIG. 19. It is shown that in each case one locking lug 31 protrudes beyond the plane of the base of the linear guide 21 on the base of the linear guide 21. Thus, a stop is formed between the coding element 9 and the plug-type connector 2. In the same way, a locking tab 31 is also provided in the case of the opposing plug-type connector 3. The locking lugs 31 are in this case arranged and matched to the length of the locking grooves 30 in such a way that, in the plug-in state, in which the opposing plug-type connector 3 is plugged onto the plug-type connector 2, only one locking lug 31 enters the locking groove 30. This ensures that the coding element 9 cannot be simultaneously connected to the plug-type connector 2 and the opposing plug-type connector 3.

Figure 21:
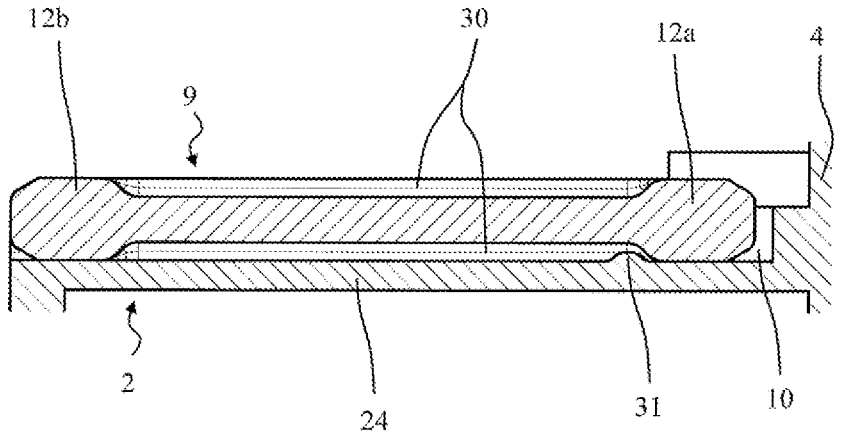
FIG. 21 shows a side sectional view of a coding element latched on the plug-type contour of a plug-type connector.

FIG. 21 shows a side sectional view of a coding element 9 latched on the plug-type contour of a plug-type connector 2. It is clear here that the locking lug 31 enters the locking groove 30 in the state of the form-fitting connection and forms a stop. Latching-over of the coding element 9 is only possible by virtue of the fact that sufficient force is exerted in the direction of longitudinal extent L on the coding element 9 for the blocking stop provided by the locking lug 31 to be overcome and for the locking lug 31 to be moved out of the locking groove 30 so that the locking lug 31 is positioned in front of the free end 12*a*, 12*b* of the coding element 9. In this position, however, the diametrically opposite locking lug 31 of the opposing plug-type connector 3 (not shown) enters the opposite locking groove 30 in order to connect the coding element in a form-fitting manner to the opposing plug-type connector, said locking lug being arranged diametrically opposite and on the other upper side of the linear guide 21.

The invention claimed is:

1. A plug-type connector arrangement, comprising:

a plug-type connector;

an opposing plug-type connector, wherein the plug-type connector and the opposing plug-type connector comprise an insulating housing, plug-type contacts in the insulating housing, and plug-type contours configured correspondingly to one another for plugging together and for conductively connecting assigned plug-type contacts in the plugged-together state;

at least one coding element, which can be accommodated displaceably on the plug-type contours of the plug-type connector and opposing plug-type connector, the at least one coding element fixing a permissible plug-in position for plugging together the plug-type connector and the opposing plug-type connector, wherein the plug-type contours of the plug-type connector and of the opposing plug-type connector comprise connecting elements, and the at least one coding element comprises at least two connecting elements spaced apart from one another, wherein the at least two connecting elements of the at least one coding element are configured to be detachably connected in a form-fitting and/or force-fitting manner to a respectively assigned connecting element of the plug-type connector or the opposing plug-type connector, the at least one coding element accessible and displaceable from the outside in the state in which the plug-type connector and the opposing plug-type connector are at least partially plugged together, to enable a connection of the assigned connecting elements to be detached from the coding element and the plug-type connector and to enable the coding element, once the coding element has been displaced in the direction of the opposing plug-type connector, to be connected to the opposing plug-type connector via the assigned connecting elements of the at least one coding element and the opposing plug-type connector.

2. The plug-type connector arrangement according to claim 1, wherein the connecting elements of the plug-type connector and the opposing plug-type connector are configured as latching troughs, and the at least two connecting elements of the at least one coding element are configured as latching fingers with a contour adapted for entering a respectively assigned latching trough, for detachable connection to the assigned latching trough in a form-fitting and/or force-fitting manner to secure the at least one coding element to the plug-type connector or the opposing plug-type connector.

3. The plug-type connector arrangement according to claim 2, wherein the latching fingers extend in the direction of longitudinal extent of the at least one coding element and have laterally protruding latching projections.

4. The plug-type connector arrangement according to claim 3, further comprising linear guides for receiving the at least one coding element, the linear guides including receiving pockets, wherein the latching troughs comprise depressions in side walls of the receiving pockets for receiving assigned latching projections of a latching finger, inserted into the receiving pocket, of a coding element.

5. The plug-type connector arrangement according to claim 1, wherein the connecting elements of the plug-type connector and the opposing plug-type connector comprise latching fingers, and the at least two connecting elements of the at least one coding element comprise latching troughs, wherein the latching fingers and the latching troughs have a contour adapted for insertion of a latching finger into a latching trough and for detachable form-fitting connection of the latching finger, inserted into a latching trough, via a latching stop and/or a force-fitting connection.

6. The plug-type connector arrangement according to claim 1, wherein the plug-type contours of the plug-type connector and the opposing plug-type connector comprise linear guides for receiving, in linearly displaceable fashion, the at least one coding element, wherein the at least one coding element comprises a guide contour matched to the linear guides.

7. The plug-type connector arrangement according to claim 6, wherein the guide contour of the at least one coding element and the linear guides form a dovetail guide.

8. The plug-type connector arrangement according to claim 7, wherein the at least one coding element has, on mutually opposite side faces, a groove which extends in each case in the direction of longitudinal extent of the at least one coding element and has sloping or curved walls.

9. The plug-type connector arrangement according to claim 6, wherein the at least one coding element comprises, on mutually opposite sides, protruding holding knobs, the linear guides comprise a connecting section, wherein a holding strip formed by the linear guides is connectable in a force-fitting manner, to an assigned holding knob of an inserted coding element connected to the plug-type connector or opposing plug-type connector, and a guide section of a linear guide, in which the linear guide is not in a force-fitting connection with an assigned holding knob.

10. The plug-type connector arrangement according to claim 9, wherein in each case two holding knobs are on diametrically opposite side walls of the at least one coding element, and wherein pairs of holding knobs are arranged on a side wall in each case so as to be vertically offset and offset with respect to one another in the direction of longitudinal extent of the at least one coding element.

11. The plug-type connector arrangement according to claim 1, wherein the at least one coding element comprises a locking groove on an upper side of said at least one coding element and on a diametrically opposite lower side of the at least one coding element, said locking groove extending in the direction of longitudinal extent of the at least one coding element, and wherein the plug-type connector and the opposing plug-type connector comprise at least one projecting locking lug, the locking groove and the at least one locking lug arranged to connect the at least one coding element either on the plug-type connector by virtue of inserting the at least one locking lug of the plug-type connector into an assigned locking groove or on the opposing plug-type connector by virtue of inserting the at least one locking lug of the opposing plug-type connector into an assigned locking groove.

12. The plug-type connector arrangement according to claim 1, wherein the at least one coding element is mirror-symmetrical or point-symmetrical.

13. A coding element for a plug-type connector arrangement, the plug-type arrangement including a plug-type connector; an opposing plug-type connector, wherein the plug-type connector and the opposing plug-type connector comprise an insulating housing, plug-type contacts in the insulating housing, and plug-type contours configured correspondingly to one another for plugging together and for conductively connecting assigned plug-type contacts in the plugged-together state, the coding element comprising:

a guide contour for mounting, in linearly displaceable fashion, on a plug-type connector and an opposing plug-type connector of the plug-type connector arrangement; and at least two connecting elements spaced apart from one another, for detachable connection, in a form-fitting and/or force-fitting manner, to a respectively assigned connecting element of a plug-type connector or an opposing plug-type connector, wherein the coding element can be accommodated displaceably on the plug-type contours of the plug-type connector and opposing plug-type connector, the at least one coding element fixing a permissible plug-in position for plugging together the plug-type connector and the opposing plug-type connector, wherein the plug-type contours of the plug-type connector and of the opposing plug-type connector comprise connecting elements, and the coding element comprises at least two connecting elements spaced apart from one another, wherein the at least two connecting elements of the coding element are configured to be detachably connected in a form-fitting and/or force-fitting manner to a respectively assigned connecting element of the plug-type connector or the opposing plug-type connector, the coding element accessible and displaceable from the outside in the state in which the plug-type connector and the opposing plug-type connector are at least partially plugged together, to enable a connection of the assigned connecting elements to be detached from the coding element and the plug-type connector and to enable the coding element, once the coding element has been displaced in the direction of the opposing plug-type connector, to be connected to the opposing plug-type connector via the assigned connecting elements of the coding element and the opposing plug-type connector.

14. The coding element according to claim 13, wherein the at least two connecting elements of the coding element comprise latching fingers at mutually opposite free ends for entering into an assigned receiving pocket of a plug-type connector or opposing plug-type connector, and for form-fitting and/or force-fitting connection to at least one latching trough of the receiving pocket or a latching projection and has laterally protruding latching projections, latching tabs or latching hooks.

15. The coding element according to claim 13, comprising, on mutually opposite side faces, a groove extending in the direction of longitudinal extent of the coding element, the groove comprising sloped or curved walls which run toward one another.

16. The coding element according to claim 13, comprising two holding knobs on diametrically opposite sides of the coding element, wherein the two holding knobs are arranged on a side wall of the coding element so as to be vertically offset and offset with respect to one another in the direction of longitudinal extent of the coding element.

17. The coding element according to claim 13, comprising, on an upper side of the coding element and on the diametrically opposite lower side of the coding element, one locking groove extending in the direction of longitudinal extent of the coding element.

18. The coding element according to claim 13, wherein the coding element is mirror-symmetrical or point-symmetrical.

19. A method for coding a plug-type connector arrangement according to claim 1 comprising at least one coding element, the method comprising:

detachably connecting, in a form-fitting and/or force-fitting manner, the at least one coding element to the plug-type connector;

plugging together the plug-type connector with the opposing plug-type connector;

detaching the connection between at least one coding element and the plug-type connector;

displacing the coding element in the direction of the opposing plug-type connector; and detachably connecting, in a form-fitting and/or force-fitting manner, the coding element to the opposing plug-type connector.

* * * * *